US005168586A

United States Patent [19]

Small

[11] Patent Number: 5,168,586

[45] Date of Patent: Dec. 8, 1992

[54] DEVICE FOR COLLECTION, STORAGE, AND USE OF SHOWER WASTE WATER

[76] Inventor: Steven D. Small, 2 Mt. Whitney Dr., San Rafael, Calif. 94903

[21] Appl. No.: 697,182

[22] Filed: May 8, 1991

[51] Int. Cl.[5] ..... A47K 3/00

[52] U.S. Cl. ..... 4/597; 4/665; 4/661; 4/605; 4/613; 220/573; 220/571; 141/98; 141/364

[58] Field of Search ..... 4/597, 602, 603, 605, 4/613, 661, 665; 141/86, 88, 98, 106, 364; 220/573, 571

[56] References Cited

U.S. PATENT DOCUMENTS

| | | | |
|---|---|---|---|
| 3,750,196 | 8/1973 | Halferty | 4/166 |
| 4,358,864 | 11/1982 | Medrano | 4/665 |
| 4,413,363 | 11/1983 | Troiano | 4/603 X |
| 4,802,599 | 2/1989 | Hill | 141/331 X |
| 4,811,937 | 3/1989 | Rothman | 269/327 |
| 4,876,969 | 10/1989 | Infanti | 108/24 |
| 4,880,156 | 11/1989 | Wallet | 232/431 |
| 5,038,418 | 8/1991 | Frey | 4/321 |

*Primary Examiner*—Henry J. Recla
*Assistant Examiner*—Thomas J. Sweet

[57] ABSTRACT

A device used to reclaim shower waste water for flushing toilets and watering gardens. During the course of a shower, several shallow-plastic molded reservoirs are situated intermediately between the shower basin and the feet of the person standing upon them. The top surface forms a sloped recess for collecting water and an open inlet port at the recessed end allows the water to drain into the reservoir. The weight of a person standing upon the top surface is supported by an internal array of posts projecting upwardly from the bottom surface. A dispenser is used in conjuction with an outlet to retain and release the collected water. When the full reservoir is placed in an upright position on top of a toilet set with the outlet at the lowermost position, the dispenser is manually actuated thus releasing water through the outlet with sufficient flow rate to flush the toilet. A shoulder strap and sprinkler accessory may be attached for use as a portable watering container in the garden. A stand with several compartments provides upright storage for several reservoirs.

8 Claims, 3 Drawing Sheets

DEVICE FOR COLLECTION, STORAGE, AND USE OF SHOWER WASTE WATER

BACKGROUND

1. Field of the Invention

This invention pertains to a portable plastic reservoir device which collects, stores, and dispenses shower waste water for flushing toilets and watering gardens.

2. Description of Prior Art

With the recent occurrence of drought, as well as environmental concerns by the public for ecology and water conservation, there has been an increasing need for a simple and affordable means of reclaiming household waste water for secondary use in flushing toilets and watering gardens. On a daily basis, showers generate a considerable amount of waste water, however, no simple and inexpensive product is currently available on the market for the public to easily collect, store, and use this water.

Currently, there are many items available to the public which reduce toilet water consumption such as low profile/high pressure flush toilets as described in U.S. Pat. No. 4,835,797. Inexpensive inserts are commonly used to displace water volume in the toilet tank such as described in U.S. Pat. No. 4,388,737. Still, other systems reclaim sink waste water in combination sink and toilet systems such as described in U.S. Pat. No. 4,358,864.

Other published means for the reclamation of gray water by those skilled in the art involve waste water recovery systems such as U.S. Pat. Nos. 4,924,536, 4,162,218, and 4,030,144 which divert waste water from sewage lines to large storage containers where the water can then be redistributed. Although many designs for these systems are available and could be implemented, the equipment and labor involved in retrofitting existing plumbing systems makes this method of water reclamation cost prohibitive to the general public. Severe water restrictions in numerous areas has forced much of the public to find other methods of reclaiming shower waste water for a second use.

The most common method used by the public for reclaiming shower waste water is one in which the basin drain is blocked prior to running the water; when the shower is completed the water collected within the shower/tub basin is bailed out with a small bucket and transferred into a larger container. The bailing involved is not only laborious and time consuming, but most people find working in dirty water unpleasant after having just gotten clean. For flushing a toilet, the water must be transferred out of the larger storage container into the smaller bucket from which the water can then be poured. The rate at which water is poured from a bucket is not easily controllable and may result in splashing up of toilet bowl water on the floor or the person.

Siphoning with a hose and a manual pump is another method used for transferring the water out of the blocked shower/tub basin. Although this method is somewhat less messy than bailing, some amount of time and work are still required for operating the manual pump. If siphoning is performed without the use of a pump, i.e. gravity feed, the water is usually transferred by hose to a barrel or larger container situated outside at a lower point of elevation.

Electrical sump pumps, used commonly for fluid handling in ornamental fountains, water falls, and fish tanks, are not only costly, but pose a hazardous potential for electric shock should a pump be defective or abused by persons. Cost, and especially liability considerations, restrict the use of sump pump systems, electrical cords, and appliances for fluid transfer in this application.

There exists a need by the general public for a simple and affordable means of collecting, storing, and using shower waste water for flushing toilets and watering gardens.

OBJECTS OF THE INVENTION

Accordingly, it is an object of this invention to provide an easy means for collecting shower waste water into a portable reservoir.

It is further object of this invention to provide the reservoir with an internal structure for the support of a person standing upon the top surface of the reservoir during a shower.

It is further object of this invention to provide an easy means of removing the full reservoir from the shower or tub basin.

It is further object of this invention to provide a means of storing several full reservoirs in an upright position within a stand until the water is required for flushing toilets and watering gardens.

It is further object of this invention to provide a clean and simple means for controlled release of the water from the reservoir with minimal manipulation and without splashing.

It is further object of this invention to provide attaching accessories allowing the reservoir to be used as a portable container for watering plants in the garden.

Further objects and advantages are to provide a reservoir system which is simple to manufacture from inexpensive materials and which will result in an affordable product available to the general public. Widespread use of this device could save scarce fresh water supplies in drought stricken areas as well a reduce the users water utility bills. Still further objects and advantages will become apparent from a consideration of the ensuing description and drawings.

Figure 1:
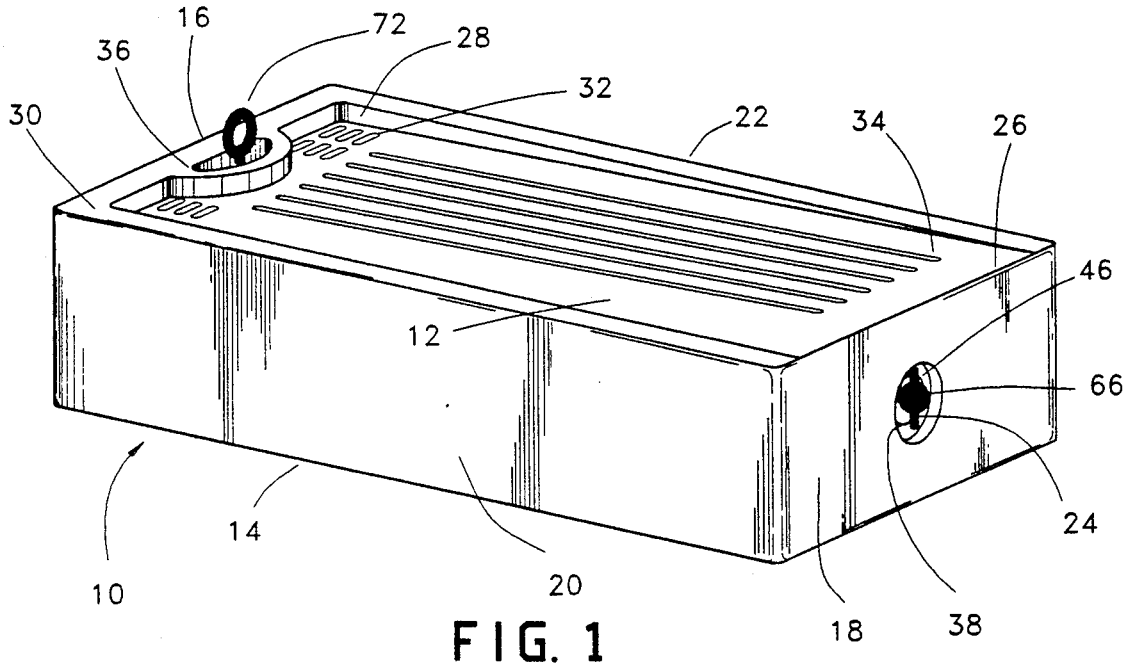
FIG. 1 is a view in perspective of the reservoir of this invention which is oriented in a position for water collection on the top surface.

| Reference Numerals in Drawings | |
|---|---|
| 10 reservoir | 12 top surface of reservoir |
| 14 bottom surface of reservoir | 16 left side of reservoir |

-continued

| Reference Numerals in Drawings | | | |
|---|---|---|---|
| 18 | right side of reservoir | 20 | front side of reservoir |
| 22 | rear side of reservoir | 24 | retaining peg |
| 26 | leading edge of sloped surface | 28 | recessed concavity |
| 30 | border of top surface | 32 | inlet ports |
| 34 | ribs on top surface | 36 | internally molded handle |
| 38 | outlet | 39 | eyelets |
| 40 | tapered posts | 42 | internal spout |
| 44 | annular groove | 46 | flat radially formed shoulder |
| 48 | rim of spout | 50 | opening |
| 52 | thumb recess | 54 | cavities for rubber pads |
| 56 | plug | 58 | stopper |
| 60 | top side of stopper | 62 | bottom side of stopper |
| 64 | plug tensioner | 66 | spherical end of tensioner |
| | | 70 | plug extensioner |
| 72 | pull loop | 74 | sealing surface of stopper |
| 76 | rubber pads | 78 | ribs of bottom surface |
| 80 | sprinkler/gardening accessory | 82 | adapter |
| 84 | adapter lip | 86 | serrated end of adapter |
| 88 | flexible hose | 90 | sprinkler head |
| 92 | serrated end of sprinkler head | 94 | orifice plate |
| 96 | holes | 98 | stand |
| 100 | compartments | 102 | shoulder strap |
| 111 | ends of retaining peg | | |

DETAILED DESCRIPTION OF PREFERRED EMBODIMENT

As best illustrated in FIG. 1, the reservoir for collecting, storing, and using shower waste water of the present invention, indicated generally at 10, comprises a shallow bodied rectangularly shaped plastic molded tank formed with top surface 12, bottom surface 14, left side 16, right side 18, front side 20, and rear side 22. From the leading edge 26, the top surface 12 slopes downwardly towards the left within a peripheral border 30 formed on three sides creating a gradual recession. The gradual recession of the top surface thus creates a concavity 28 towards the left side for water to collect. The top surface 12, which collects falling water, channels the water towards the left where it drains into the resevoir through open inlet ports 32. Long convexly formed ribs 34, extend the length of the top surface to provide both wall strength and traction with a person's feet. Although not represented in the drawing, the top surface is also roughly textured for additional traction.

Figure 2:
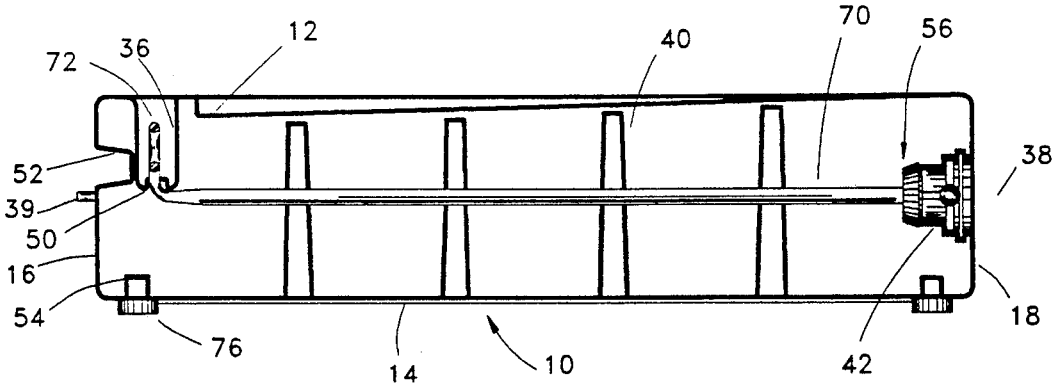
FIG. 2 is a front section view taken through the reservoir revealing internal features.
Figure 5:
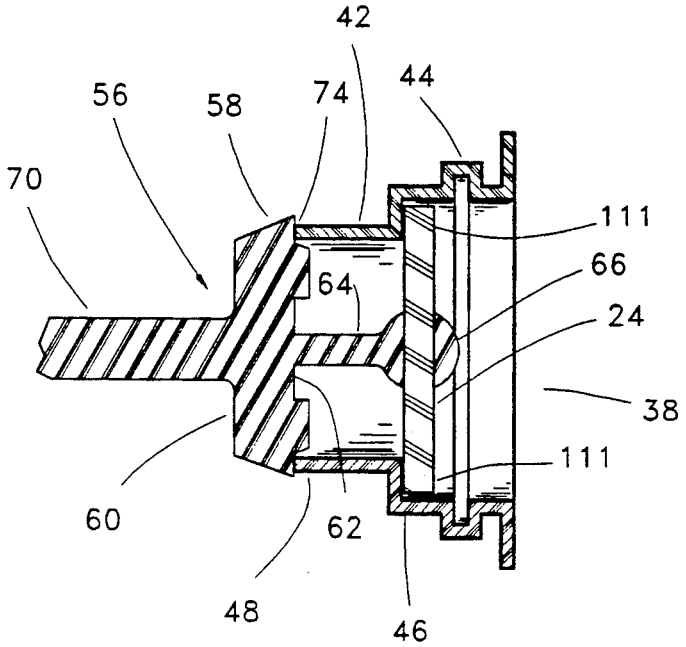
FIG. 5 is a detailed cross-sectional view of the stopper portion of the plug elastically loaded against the rim of the internal spout.

Referring now to FIGS. 1 & 2, an outlet 38, from which the collected water is dispensed, is shown centered on the right side of the reservoir 18. The cylindrically formed outlet projects into the reservoir. FIG. 5 shows a detailed section view of this outlet, and its mating plug 56-soon to be discussed. The outlet 38 forms a cylindrically shaped internal spout 42, which axially projects into the reservoir and terminates with a rim 48. A flat radially formed shoulder 46 is formed within the wall of the outlet in a plane perpendicular to the central axis of the outlet and serves as a load bearing surface for a retaining peg 24, soon to be discussed. An annular groove 44, also molded into the outlet wall, receives in complimentary the lip of an adapter from the sprinkler/gardening accessory-soon to be discussed.

Shown in FIGS. 1 & 2 is an internally molded handle 36 which projects downwardly from the top surface into the reservoir. An opening 50 is provided at the bottom of the handle for a pull loop 72 to penetrate through. A molded thumb recess 52, shown in FIGS. 2 & 3, projects into the reservoir and is centered on the left side 16. The thumb recess enables a better grasp of the reservoir and provides internal support for the handle 36 when the full reservoir is lifted.

Figure 3:
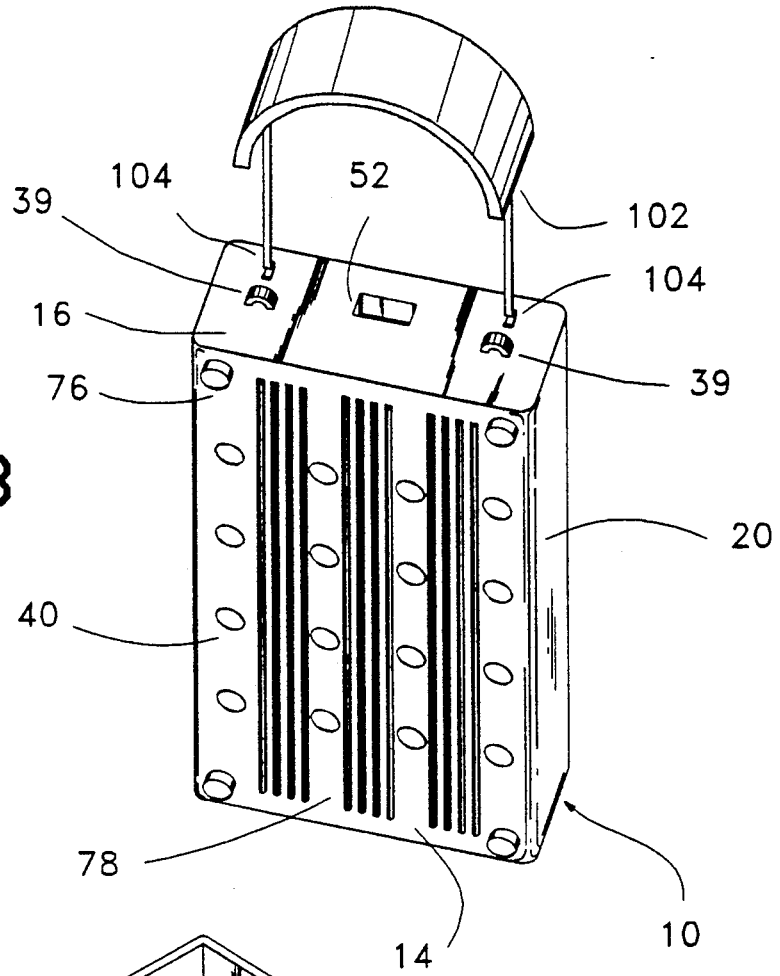
FIG. 3 is a view in perspective of the bottom surface of the reservoir; the reservoir is shown in its upright position with an attaching shoulder strap.

Referring now to FIG. 2, four short cylindrically molded cavities 54 project into the reservoir form the bottom surface 14 at each of the four corners. A molded rubber pad 76 is press fit into each cavity thus providing traction for the reservoir against the basin surface. As shown in FIG. 3, convexly formed ribs 78 which extend the length of the bottom surface 14 are provided for wall strength. In addition, the ribs provide a gap which allows water not collected by the reservoir access to the basin drain underneath the reservoir.

An array of hollow tapering posts 40 formed at the bottom surface 14, shown in FIGS. 2 & 3, penetrate upwardly through the reservoir to support the top surface 12. Post height shortens towards the left to accommodate the sloped top surface which recesses in this direction. The array of posts form an internal structure capable of supporting the weight of a person standing on the top surface.

A shoulder strap accessory 102 is shown in FIG. 3. Hooks 104, 104 of the shoulder strap assemble into molded eyelets 39,39 formed on the left side of the reservoir 16. The shoulder strap is used for aid in rotating/lifting the full reservoir out of the basin and for carrying the reservoir while watering in the garden. When the reservoir is filled to capacity, it is reoriented to an upright position for storing and dispensing the collected water, as shown in FIG. 3. In this orientation, the handle and inlet ports are situated above the outlet which is located at the bottom. In the upright position, the water level inside the reservoir is just below the open inlet ports-the inlet ports being open to atmosphere.

Referring now to FIGS. 2 & 5, a molded rubber plug 56 comprising three integral features is shown assembled within the reservoir. The rubber plug 56 comprises a stopper portion 58 which, when loaded against the rim of the spout 48, creates a watertight seal. The rubber plug comprises a long cord-like extension 70 with a pull loop 72 at the end that penetrates outside the reservoir through an opening 50 provided in the handle 36. Pulling the plug extension 70 by the loop 72 disengages the stopper 58. Lastly, the rubber plug 56 comprises an elastic tensioner 64 which loads the stopper against the rim of the spout 48 when seated in a neutral position; the tensioner also returns the stopper to its seated position.

The long cord-like extension 70 is formed at the top side of the stopper 60 at the center and extends through the reservoir between the posts. Both cross-sections of the extension 70 and the tensioner 64 are solid circular, however the extension diameter is greater than that of the tensioner. Thus when loop 72 is pulled, stretching takes place in the tensioner and not in the extension. As earlier stated, the loop 72 of the extension 70 is accessible within the internally molded handle 36 for pulling by a finger.

The diameter of the stopper's bottom side 62 is greater than that of the spout rim, thus contact between the two creates a circular watertight seal 74. The diameter of the top side of the stopper 60 is smaller than that of the bottom side. Thus, the tapering stopper design facilitates easy insertion of the plug through the spout 42 during assembly. The plug tensioner 64 is formed from the bottom side of the stopper 62 at the center. As previously described, the cross-section of the tensioner is solid circular and the neoprene rubber material allows this section to stretch. A retaining peg 24 peetrates through an opening provided in the spherical end of the tensioner 66. The function of the peg is to retain the spherical end of the tensioner and keep it statically fixed. The ends of the peg 111,111 bear against the flat radially formed shoulder 46 within the wall of the outlet 38. With the stopper seated in a neutral position, the tensioner section 64 is situated intermediately between the bottom of the stopper 62 and the fixed spherical end 66. Situated as such, the tensioner section is elastically stretched slightly beyond its free length which thus applies a load to the bottom side of the stopper 62 at its center and creates a watertight seal 74 around the rim of the spout 48. An equal and opposite static load reaction is shared by both ends of the retaining peg 111,111 which, as earlier stated, bear against the flat radial shoulder.

Figure 6:
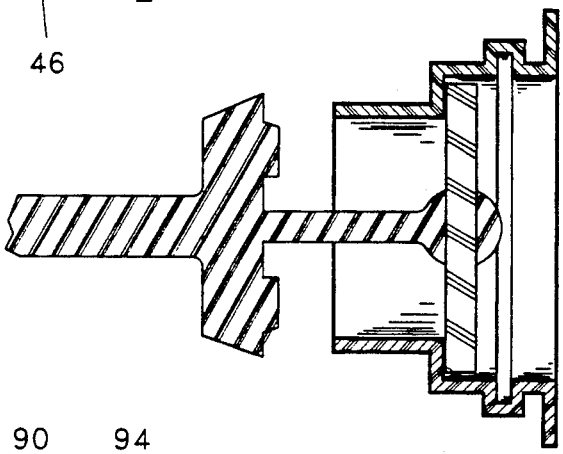
FIG. 6 is a detailed cross-sectional view of the stopper pulled away/disengaged from the internal spout for dispensing water.

FIG. 6 is a cross-sectional view showing the plug tensioner stretched and the stopper disengaged from the spout thus allowing the release of water through the outlet. The amount of stopper disengagement (stretching of the tensioner) is directly proportional to the pulling force applied at the loop. Thus the water flow rate is controlled by the amount of pulling force a person applies to the loop located in the handle. Upon releasing the loop of the plug extension, the tensioner returns the stopper to its seated position.

Figure 4:
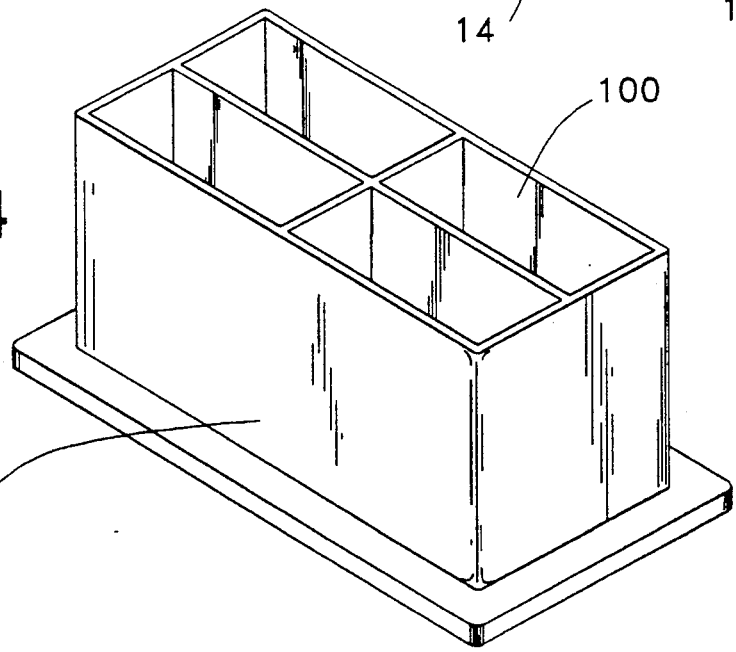
FIG. 4 is a view in perspective of a stand used for upright storage of four reservoirs.

A rigid plastic stand 98 which comprises several compartments 100 into which reservoirs can be stored in an upright position is shown in FIG. 4. For flushing a toilet, the full reservoir is positioned upright over the toilet bowl with the outlet facing downward while its weight is supported by the toilet seat or rim of the bowl. As mentioned beforehand, pulling of the extension loop will release a controllable flow of water into the bowl sufficient to flush the bowl while at the same time avoiding splash-up of the water. The flow of water is stopped when the loop is released.

Figure 7:
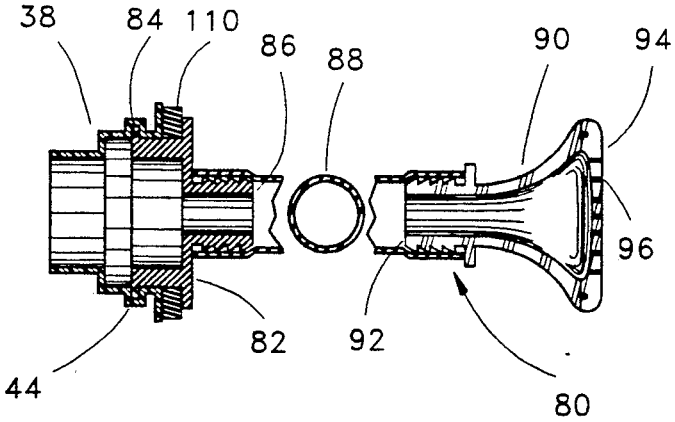
FIG. 7 is a detailed cross-sectional view of the sprinkler/gardening accessory assembled within the outlet of the reservoir.

FIG. 7 is a cross-sectional view showing the sprinkler/gardening accessory 80 assembled within the outlet 38. This accessory is easily assembled to the reservoir by inserting an adapter 82 into the outlet. When the sprinkler 80 is used in conjunction the shoulder strap, the reservoir can be used as a portable watering container for use in the garden. The sprinkler/gardening accessory 80 comprises an adapter 82, a flexible hose 88, and a sprinkler head 90. The sprinkler head comprises an orifice plate 94 with a plurality of holes 96 from which water is dispersed in a spray. The sprinkler head 90 also comprises a serrated end 92 which when assembled into the flexible hose 88 creates a watertight connection. Likewise, the adapter 82 comprises a serrated end 86 which is inserted into the flexible hose 88 and provides a watertight connection. Thus, the flexible hose 88, which connects the sprinkler head 90 to the adapter 82, allows adjustability in movement for dispersing the water. The the adapter 82 is inserted into the outlet 38 whereby the the lip of the adapter 84 is received in complimentary by a formed annular groove 44. A rubber washer 110, compressed between the external face of the outlet and the adapter, is used to insure watertight integrity between the reservoir and the sprinkler/gardening accessory.

While this invention has been described in conjunction with a preferred embodiment thereof, it is obvious that modifications and changes therein may be made by those skilled in the art to which it pertains without departing from the spirit and scope of this invention, as defined by the claims appended hereto.

SUMMARY OF THE INVENTION

In carrying out this invention, I provide a shallow-bodied rectangularly shaped plastic molded reservoir for collecting, storing, and dispensing shower waste water. The collected waste water can be used for flushing toilets and watering gardens. During the course of a shower, the reservoir is situated intermediately between the shower/tub basin and the feet of the person standing upon it. Thus, the reservoir creates a "false bottom" into which waste water is collected. The overall width and depth of the reservoir allows two more reservoirs to be placed within a variety of differently shaped basins. Thus, reservoirs will fit within a curve shaped bath tub basin or a rectangularly shaped standard shower basin. The height of the reservoir, approximately five inches, is much less than the width and depth making the profile of the reservoir relatively shallow. The wide upwardly exposed top surface of the reservoir defines a receptor for the collection of freely falling water.

With the reservoir situated as described above, the central portion of the top surface gradually recesses between front, rear, and left sides starting at the right leading edge. The sloping top surface creates a concavity which gradually increases towards the left. Free falling water, which is caught by the top surface or which runs down the person's legs, is thus channeled towards the left where it drains into the reservoir through a set of open inlet ports.

An outlet, located on the right side of the reservoir, comprises a cylindrically shaped internal spout which projects axially into the reservoir. Formed within the wall of the outlet are a flat radially molded surface shoulder and a annular groove. A rubber plug, assembled inside of the reservoir, comprises three integral features and is elastically loaded against the rim of the spout.

Rubber pads, located on the bottom surface, prevent the reservoir from slipping against the surface of the basin. Structural ribs located on the top and bottom surface provide wall strength for the full reservoir when it is reoriented 90° to an upright position and removed from the basin. The ribs on the bottom surface also provide a gap between the reservoir and the basin such that waste water not collected can reach the basin drain underneath the reservoir. The sloped top surface is textured to provide additional traction with the feet of the person standing upon the reservoir.

Support of the top surface is provided by an array of hollow posts integrally molded from the bottom surface. The posts project upwardly through the reservoir towards the underside of the top surface. Thus, the weight of the person standing upon the top surface is distributed to the posts. Thus, the posts support the top surface and prevent the reservoir from collapsing.

In its working state, the reservoir's top surface collects shower waste water and directs it towards inlet ports where the water drains into the reservoir. When the reservoir has reached full capacity, excess water runs over the peripheral sides to the basin drain located underneath the reservoir. When the shower is complete, the reservoir is tilted 90° to an upright position by an internally molded handle. The handle is supported internally by a thumb recess which projects into the reservoir from the left side. In the upright position, the inlet ports are situated towards the upper end and located above the outlet which is situated at the bottom end. A shoulder strap accessory can be assembled by hooks to two eyelets molded on the upright end. The shoulder strap can be used by those who need assistance in lifting the full reservoir. The full reservoir can then be stored in the upright position within a stand comprising several compartments for reservoirs.

As earlier stated, assembled within the reservoir is a rubber plug used to retain and dispense the collected water. The plug comprises three integral sections-an extension, a stopper, and an tensioner. The stopper, when seated and loaded against the rim of the internal spout, creates a watertight seal for water retention. The tensioner, with solid a circular cross-section and spherical end, projects from the bottom side of the stopper at its central axis. A retaining peg is assembled into a hole provided at the tensioner's spherical end. The retaining peg bears against the flat radial shoulder formed in the outlet and keeps the spherical end of the tensioner fixed. The distance between the seated stopper and the end of the tensioner stretches the tensioner slightly past its free length. Thus, the tension provided loads the stopper against the rim of the spout and the peg ends against the flat shoulder.

The long cord-like extension of the plug projects from the top side of the stopper at its central axis. The extension, with a solid circular cross-section and a loop end, extends the length of the reservoir internally between the posts. The looped end penetrates to the exterior through an opening provided at the bottom of the internally molded handle. Pulling of extension's looped end stretches the tensioner and disengages the stopper from the spout, thus water is released. The amount of stopper disengagement (stretching of the tensioner) is proportionately controlled by the amount of force applied in pulling the extension; thus water flow rate can be controlled by the amount of pull applied to the loop.

For flushing a toilet, the reservoir is situated in the upright position over the toilet bowl and is supported by either the toilet seat or the rim of the bowl. Pulling of the loop releases a controlled amount of water for flushing the bowl. Release of the loop allows the stretched tensioner to return the stopper to its seated position thus stopping the flow of water.

A sprinkler/gardening accessory, comprising an adapter, hose, and sprinkler head, can be attached to the outlet of the reservoir converting the device into a portable container for watering gardens. The lip of the adapter snaps into annular groove molded within the wall of the outlet. When the stopper is disengaged, water flows through the outlet and the attached sprinkler accessory and is dispersed in a spray. The shoulder strap accessory is attached to the reservoir such that the reservoir can be carried and used for watering in the garden.

Ramifications and Scope

The limiting factors of this device are the weight of a full reservoir and the ability for a person to lift and carry it. Although the size and volume of the reservoir could vary, the preferred embodiment retains approximately 4.50 U.S. gallons an weighs approximately 39 lbs. The device is not intended for use by persons with physical disabilities or by children. The shoulder strap accessory is provided to help those who need assistance in lifting and carrying a full reservoir. The volume of water collected in a full reservoir is sufficient for one or two toilet flushes depending upon the design of the toilet.

Although the description above contains many specificities, these should not be construed as limiting the scope of the invention but merely providing illustrations of some of the preferred embodiments of this invention. Although blow molded high density polyethylene is the preferred process and material, other processes and materials could be implemented for manufacturing of this invention. The peripheral shape of the reservoir does not necessarily have to be rectangular but rather could be circular or elliptical. If the shape is circular, the inlet could be situated at the center of a conically recessing top surface. Moreover, one opening with a plug could serve as both the inlet and the outlet. The top surface of the reservoir does not necessarily have to slope if it is recessed and entirely bounded by a bordering edge. Support for the top surface could be provided by internal structural means such as baffles, spacers, or various molded extrusions. Another design of this invention could incorporate a separate platform surface, situated above the reservoirs, which would support the weight of the person and both collect and distribute water to the underlying reservoirs. The closure and dispensing means of the reservoir for retaining and releasing the water could be of a more conventional design. Such widely used conventional designs include a stopper compressed between a threaded cap and external spout and flexible one piece rubber caps, commonly used as means for dispensing wine from a storage box. Still, many other means of retaining and releasing the water could be implemented.

Thus, the scope of this invention should be determined by the appended claims and their legal equivalent, rather than by the examples given.

I claim:

1. A device for the collection, storage, and use of shower waste water comprising:

a portable molded reservoir in combination with a dispenser, the reservoir being of sufficient size to be accommodated within a shower basin and comprising a top surface and a bottom surface interconnected by peripheral sides, said peripheral sides comprising a right side, a left side, a front side, and a rear side, said top surface slopes downwardly below said peripheral sides thus forming a marginal concavity being formed to greatest extent nearest said left side, the sloped top surface further comprising an open inlet port within said marginal concavity in close proximity to said left side, whereby said top surface defines a broad upwardly exposed receptor for collecting and draining shower water into the reservoir through said open inlet port, said bottom surface comprising means for providing an open space between the reservoir and said shower basin such that water not collected will have access to a shower drain, the reservoir further comprising an internal structure for vertically supporting the weight of a person standing upon the reservoir during the course of a shower, the reservoir further comprising an outlet formed centrally on said right side, said dispenser comprising means for securing to and sealing said outlet and further comprising means for releasing water from the reservoir upon being manually actuated, the reservoir upon being filled with water within said shower basin is reorientated to an upright vertical position by clockwise rotation of ninety degrees about said right side thus disposing said right side and said outlet to a lowermost position and disposing said left side and said open inlet port to an upper position, wherein reorientation of the reservoir will permit a small leakage of water out of said open inlet port into said shower basin until water level within the reservoir drops to an elevation just below that of said open inlet port, whereby the accumulated water within the full upright reservoir may be removed from said shower basin and released through said outlet by manual actuation of said dispenser for use in several water consuming activities such as flushing toilets and watering gardens.

2. The device of claim 1, wherein said internal structure comprises an array of hollow posts, the posts integrally formed from said bottom surface project upwardly through the reservoir extending to said top surface, whereby the weight of a person standing upon said top surface of the reservoir is supported axially by the posts,

3. The device of claim 1 wherein said reservoir is molded from a thermoplastic material.

4. The device of claim 1 wherein said reservoir further comprises handle means for holding the reservoir secured thereto.

5. The device of claim 1 wherein said bottom surface comprises formed cavities for acceptance of rubber pads, whereby said rubber pads provide traction between the reservoir and said shower basin.

6. The device of claim 1 wherein said outlet comprises means for attaching a sprinkler accessory, the reservoir further comprises means for attaching a shoulder strap, whereby attachment of said sprinkler accessory and said shoulder strap allow the reservoir to be carried and used in said gardens for watering plants.

7. The device of claim 1 wherein said means for providing an open space between the reservoir and said shower basin comprises convexly molded protrusions which downwardly project from said bottom surface of the reservoir towards said shower basin.

8. The device of claim 1 further comprising a stand with compartments for the upright storage of several reservoirs.

* * * * *